United States Patent [19]

Bixby et al.

[11] 4,366,029

[45] Dec. 28, 1982

[54] PIVOTING BACK ONE-SPOT COKE CAR

[75] Inventors: Robert P. Bixby, Pittsburgh; Eugene Ziegler, McKeesport, both of Pa.

[73] Assignee: Koppers Company, Inc., Pittsburgh, Pa.

[21] Appl. No.: 297,753

[22] Filed: Aug. 31, 1981

[51] Int. Cl.[3] ..... B61D 3/10; B61D 9/02; C10B 39/14

[52] U.S. Cl. ..... 202/262; 105/254; 105/270; 202/263

[58] Field of Search ..... 202/262, 263; 105/254, 105/257, 269, 277

[56] References Cited

U.S. PATENT DOCUMENTS

| | | | |
|---|---|---|---|
| 710,391 | 10/1902 | Maurer et al. | 105/254 |
| 1,956,994 | 5/1934 | Parsons | 105/254 |
| 3,099,229 | 7/1963 | Wethly | 105/254 |
| 4,263,852 | 4/1981 | Kramunger | 202/262 |
| 4,274,923 | 6/1981 | Mahar | 202/263 |
| 4,312,712 | 1/1982 | Kwasnik et al. | 105/257 |

*Primary Examiner*—Bradley Garris

*Attorney, Agent, or Firm*—Thomas L. Sivak; Oscar B. Brumback

[57] ABSTRACT

A pivoting back one-spot coke quenching car for use in coke batteries having a coke bench structure with clearances which make the use of one-spot cars impractical. The novel structure of the present invention permits the car to have sufficient volume to receive coke in one-spot while providing a pivoting back that allows the car to tilt, travel and dump in coke batteries that have close clearances.

2 Claims, 4 Drawing Figures

PIVOTING BACK ONE-SPOT COKE CAR

BACKGROUND OF THE INVENTION

1. Field of the Invention

This invention relates to one-spot coke quenching cars, and more particularly, to a pivoting back for such cars which permits additional travel clearance and the dumping of coke on batteries which have close coke bench clearances.

2. Description of the Prior Art

A "one-spot" coke quenching car receives coke from a coke oven while remaining stationary rather than traveling during the discharge. Examples of such one-spot coke quenching cars can be found in U.S. Pat. Nos. 3,868,309 and 4,135,986.

The guiding factor behind the use of a one-spot car for unloading coke from a battery is that it makes possible the application of certain pollution control devices such as hoods which minimize the escape of noxious gases and particulates during discharge of the coke from the coke oven. There is one drawback to the use of one-spot cars and that is in many existing coke oven batteries, the clearance between the coke bench and the dumping station requires that the one-spot car be of minimal size to permit tilting and unloading of the coke into the dumping station. The minimal size creates a problem in that often-times since the car does not travel, the entire discharge from the oven cannot be placed in the car without some spillage or the pollution control devices cannot be used or are not effective because of the resulting coke line in the car.

SUMMARY OF THE INVENTION

The present invention overcomes the aforementioned problems of the prior art by providing a one-spot coke quenching car having a pivotable car back which provides sufficient volume during discharge of the coke into the car for the car to operate as a one-spot car. However, when the car is returned to the vicinity of the coke wharf for dumping, the back can be pivoted to reduce the dimensions of the car to permit it to clear all structures for dumping. In addition, the reduced dimensions provide additional travel to any structures which could not normally accommodate a conventional sized one-spot car.

DESCRIPTION OF THE PREFERRED EMBODIMENT

A complete description of a one-spot coke quenching car capable of being adapted to incorporate the present invention and the attendant structure of the coke battery including the coke bench is fully set forth in U.S. Pat. No. 4,135,986, which description is incorporated herein by reference. This description will only be repeated herein to the extent necessary to enable one skilled in the art to practice the present invention.

Figure 1:
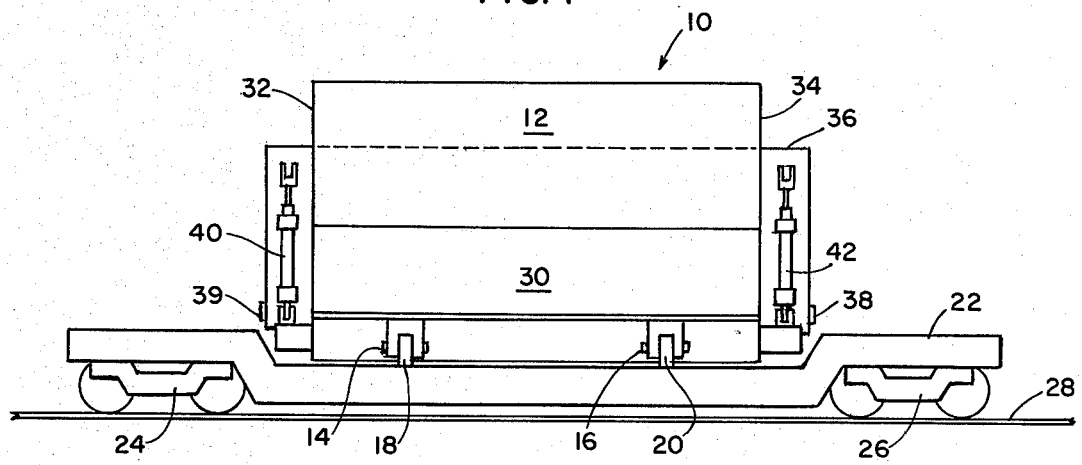
FIG. 1 is a front elevational view of a one-spot coke quench car having the pivotable back of the present invention.
Figure 2:
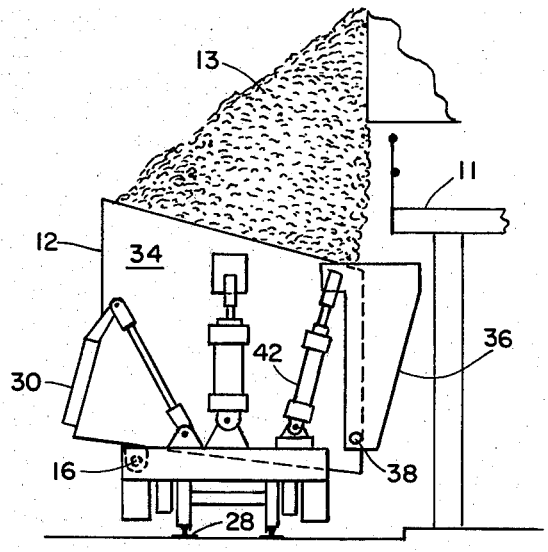
FIG. 2 is an end elevational view showing the pivotable back in the extended position during loading.
Figure 3:
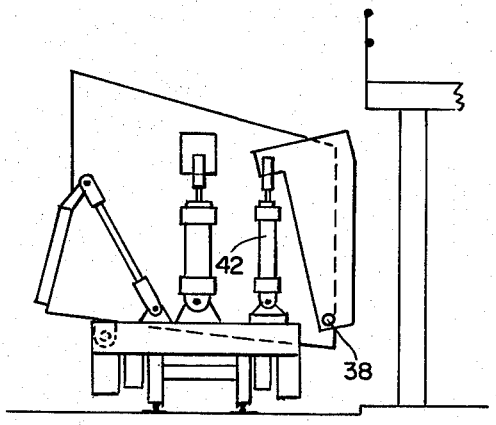
FIG. 3 is an end elevation view showing the pivotable back in the retracted position during car travel.
Figure 4:
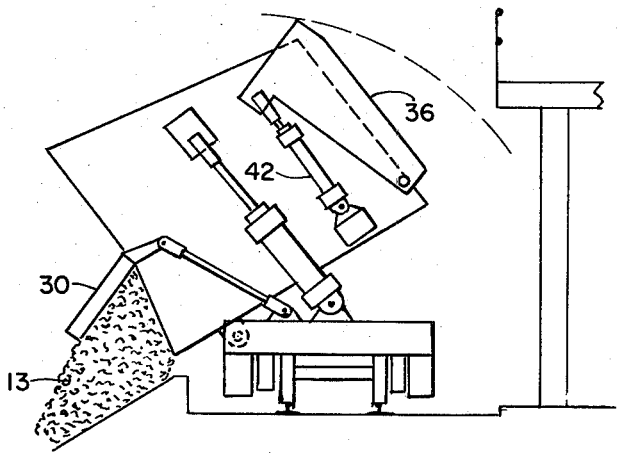
FIG. 4 is an end elevation view showing the pivotable back in the retracted position during dumping.

Referring to FIG. 1, a one-spot coke quenching car 10 is comprised of a body 12 which is rotably supported on bearings 14 and 16 so that body 12 may rotate for the dump of the coke received from the coke oven battery, not shown. FIG. 2 does show the coke bench 11 of a battery schematically for purposes of illustrating the present invention. Bearings 14 and 16 are journaled to supports 18 and 20 which are fixably mounted to flat-bed frame 22. Frame 22 is mounted on trucks 24 and 26 that carry it over rails 28 along the coke battery and to and from the quench station and to the coke wharf for dumping. As in a conventional car, the body includes a plurality of ports which receive the coke, 13 from the coke ovens, receive the quenching liquid at the quench station and provide the exit Gate 30 for dumping the coke at the coke wharf. As shown in FIG. 4, Gate 30 is on the front side of body 12 as the sides are referred to herein. Ends 32 and 34 of body 12 are tapered as shown in FIG. 2 to permit the pivoting back 36 to be pivoted toward the centerline of body 12. When pivoting back 36 is retracted toward the centerline of body 12, the dimensions provide travel clearance to structures along the battery and also permit the car to clear the coke bench for dumping, FIG. 4.

The pivotable back side 36 of body 12 of the one-spot car of the present invention is pivotably fixed to ends 32 and 34 by means of pivot pins 38 and 39. In the preferred embodiment, side 36 is trapezoidal in shape, the top of side 36 having the greater altitude to compensate for the tapers in ends 32 and 34 of body 12. This combination of shapes permits body 12 to be of a larger dimension during discharge of the coke into the car and of a lesser dimension during dumping of the coke at the coke wharf.

Fixed by conventional means to ends 32 and 34 and side 36 are hydraulic cylinders 40 and 42. Cylinders 40 and 42 are controlled in a conventional manner that when the coke has been discharged into body 12, the rams are activated to retract pivotable back side 36 toward the centerline of body 12.

While we have described a certain preferred embodiment of our invention, it is understood that it may otherwise be embodied within the scope of the following claims.

What is claimed:

1. In a one-spot coke quenching car, comprised of a frame and a body rotatably mounted thereon, said body comprised of ends and a front and back side and a bottom wall, wherein the ends, front and back side and bottom wall of said body are rotatable as a unit, the improvement comprising:

(a) said back side being pivotably mounted to said ends to allow said back side to pivot forward and toward the centerline of said body, and (b) means for pivoting said back side.

2. The one-spot coke quenching car of claim 1 wherein said pivoting means are hydraulic cylinders.

* * * * *